US009630789B2

(12) United States Patent
Iwama

(10) Patent No.: US 9,630,789 B2
(45) Date of Patent: Apr. 25, 2017

(54) SHEET STORAGE DEVICE AND IMAGE FORMING APPARATUS

(71) Applicant: BROTHER KOGYO KABUSHIKI KAISHA, Nagoya-shi, Aichi-ken (JP)

(72) Inventor: Noritaka Iwama, Aichi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/837,690

(22) Filed: Aug. 27, 2015

(65) Prior Publication Data

US 2016/0060050 A1 Mar. 3, 2016

(30) Foreign Application Priority Data

Aug. 29, 2014 (JP) ..... 2014-175024

(51) Int. Cl.

| | |
|---|---|
| ***B65H 1/14*** | (2006.01) |
| ***B65H 1/08*** | (2006.01) |
| ***G03G 15/00*** | (2006.01) |
| ***B65H 1/26*** | (2006.01) |
| *B65H 3/52* | (2006.01) |

(52) U.S. Cl.

CPC ..... *B65H 1/14* (2013.01); *B65H 1/08* (2013.01); *B65H 1/266* (2013.01); *G03G 15/6502* (2013.01); *B65H 3/5223* (2013.01); *B65H 2405/1118* (2013.01);

(Continued)

(58) Field of Classification Search

CPC ..... B65H 1/08; B65H 1/14; B65H 3/5223; B65H 2405/1117; B65H 2405/11172; B65H 2405/1118; B65H 2405/111

See application file for complete search history.

(56) References Cited

U.S. PATENT DOCUMENTS 7,597,313 B2 * 10/2009 Dan ..... B41J 13/103 271/10.03
7,665,726 B2 * 2/2010 Kotera ..... B65H 1/266 271/145

(Continued)

FOREIGN PATENT DOCUMENTS

CN 101549795 A 10/2009
CN 101607640 A 12/2009

(Continued)

OTHER PUBLICATIONS

First Office Action for counterpart Chinese Patent Application No. 201510542408.6, mailed Nov. 3, 2016.

*Primary Examiner* — Jeremy R Severson
(74) *Attorney, Agent, or Firm* — Merchant & Gould P.C

(57) ABSTRACT

A sheet storage device, including a storage tray configured to store a sheet therein; a board, on which the sheet to be stored in the storage tray is placed, the board being configured to be swingably supported by the storage tray at a first position closer to a first end thereof than a second end being opposite from the first end to swing about a swing axis; and a projection configured to protrude from a bottom of the storage tray toward the board, the projection including a contact part being configured to contact the board member at a second position closer to the second end than to the first end of the board, is provided. A length of the contact part along an axial direction of the swing axis is smaller than a length of the board at the second position closer to the second end.

7 Claims, 8 Drawing Sheets

(52) U.S. Cl.
CPC ..... *B65H 2405/11172* (2013.01); *B65H 2601/524* (2013.01); *G03G 15/6511* (2013.01)

(56) References Cited

U.S. PATENT DOCUMENTS

| | | | | |
|---|---|---|---|---|
| 8,074,979 | B2 | 12/2011 | Kawamoto | |
| 8,496,241 | B2 | 7/2013 | Osakabe et al. | |
| 8,577,253 | B2 | 11/2013 | Mori et al. | |
| 8,616,545 | B2 | 12/2013 | Takiguchi | |
| 9,296,578 | B2 | 3/2016 | Ohta | |
| 2007/0273082 | A1* | 11/2007 | Sawai | B65H 1/14 271/147 |
| 2011/0140347 | A1* | 6/2011 | Nishitani | B65H 1/14 271/157 |
| 2013/0049291 | A1* | 2/2013 | Ohtsuki | B65H 1/08 271/162 |
| 2013/0134657 | A1 | 5/2013 | Nishioka | |
| 2015/0108713 | A1* | 4/2015 | Yoshitsugu | B65H 31/08 271/217 |

FOREIGN PATENT DOCUMENTS

| | | | |
|---|---|---|---|
| CN | 102190162 | A | 9/2011 |
| CN | 102674031 | A | 9/2012 |
| CN | 103964249 | A | 8/2014 |
| JP | 9-86691 | A | 3/1997 |
| JP | 2000318849 | A | 11/2000 |
| JP | 2007-254144 | A | 10/2007 |
| JP | 2007-269462 | A | 10/2007 |
| JP | 2011-0126648 | A | 6/2011 |
| JP | 2013-112426 | A | 6/2013 |

* cited by examiner

SHEET STORAGE DEVICE AND IMAGE FORMING APPARATUS

CROSS REFERENCE TO RELATED APPLICATION

This application claims priority from Japanese Patent Application No. 2014-175024, filed on Aug. 29, 2014, the entire subject matter of which is incorporated herein by reference.

BACKGROUND

1. Technical Field

The present invention relates to a sheet storage device and an image forming apparatus.

2. Related Art

A sheet storage device for, for example, a printer is known. The sheet storage device may have a feeder tray and a stackable board. The feeder tray may be in a form of a top-open box, in which sheets may be stored. The sheets to be stored in the feeder tray may be stacked on top of the stackable board. The stackable board may be swingably supported by the feeder tray at an edge on one end thereof so that another edge on the other end may be movable vertically. The feeder tray may be movable with respect to a printer body to be drawn out of or installed into the printer body.

When the feeder tray is moved with respect to the printer body, vibration may be caused in the feeder tray, and the stackable board may rattle in a way such that each sideward edge on the other end of the stackable board conflicts alternately with a bottom of the feeder tray, and repetitive rattling noise may be produced.

SUMMARY

The present disclosure is advantageous in that a sheet storage device, in which rattling noise may be reduced when the sheet storage device is handled, is provided. Further, an image forming apparatus having the sheet storage device may be provided.

According to an aspect of the present disclosure, a sheet storage device, including a storage tray configured to store a sheet therein; a board, on which the sheet to be stored in the storage tray is placed, the board being configured to be swingably supported by the storage tray at a first position closer to a first end thereof than a second end being opposite from the first end to swing about a swing axis; and a projection configured to protrude from a bottom of the storage tray toward the board, the projection including a contact part configured to contact the board at a second position closer to the second end than to the first end of the board, is provided. A length of the contact part along an axial direction being a direction of the swing axis is smaller than a length of the board at the second position closer to the second end along the axial direction.

According to another aspect of the present disclosure, an image forming apparatus, including: a casing with a drive source configured to generate a driving force; and a sheet storage device configured to be movable with respect to the casing, is provided. The sheet storage device includes: a storage tray configured to store a sheet therein; a board, on which the sheet to be stored in the storage tray is placed, the board being configured to be swingably supported by the storage tray at a first position closer to a first end thereof than a second end being opposite from the first end to swing about a swing axis; a projection configured to protrude from a bottom of the storage tray toward the board, the projection comprising a contact part configured to contact the board at a second position closer to the second end than to the first end of the board; and a lifting plate configured to be driven by input of the driving force, the lifting plate being configured to uplift the board at the second position closer to the second end. The first position closer to the first end of the board is supported at lateral ends thereof along an axial direction being a direction of the swing axis. A length of the contact part along the axial direction is smaller than a length of the board at the second position closer to the second end along the axial direction.

BRIEF DESCRIPTION OF THE ACCOMPANYING DRAWINGS

DETAILED DESCRIPTION

Figure 1:
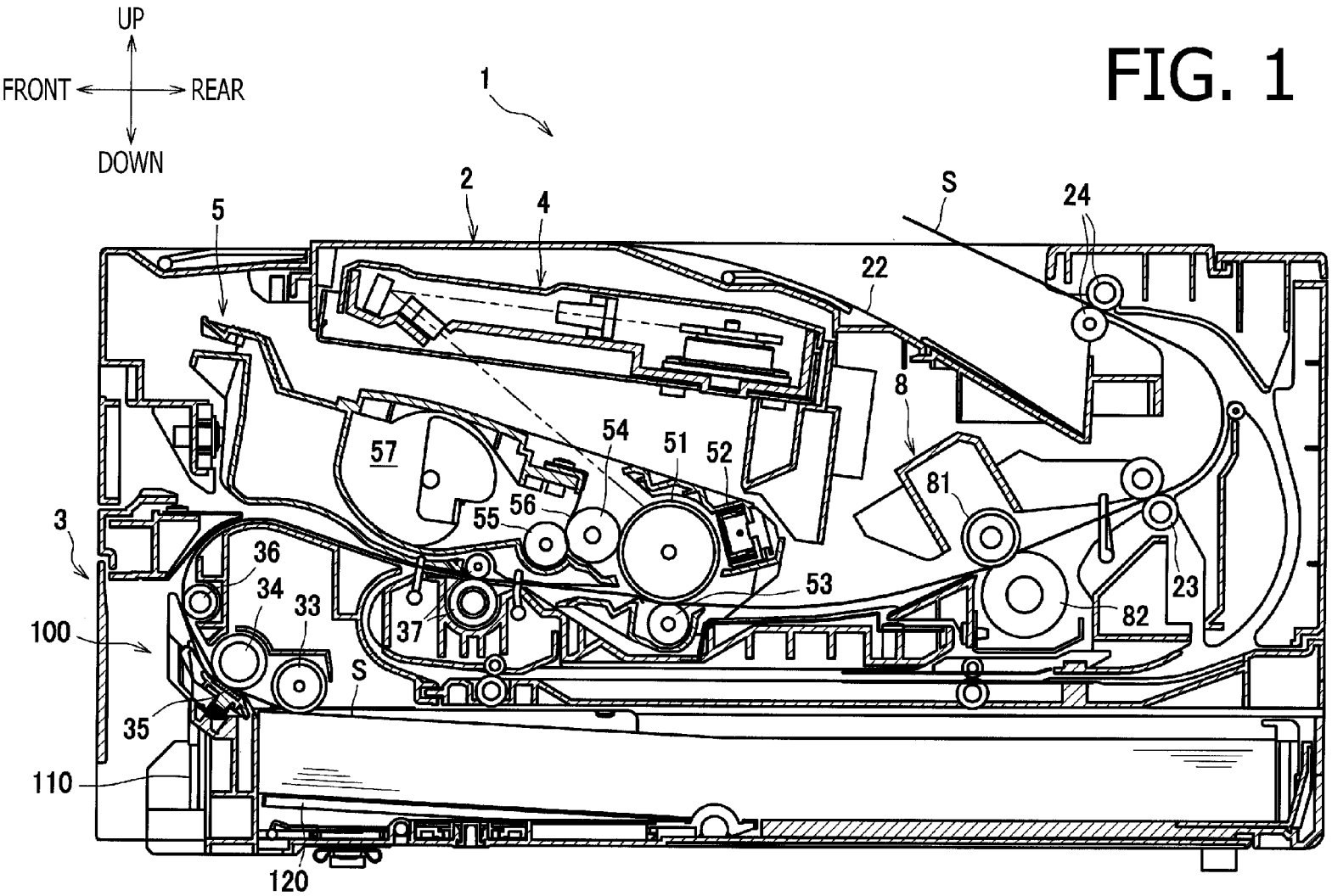
FIG. 1 is a cross-sectional side view of a laser printer according to an embodiment of the present disclosure.

Hereinafter, an embodiment of the present invention will be described with reference to the accompanying drawings. First, an overall configuration of a laser printer 1 according to the embodiment will be described, and later, a sheet storage device 100 in the laser printer 1 will be described in detail. In the following description, directions concerning the laser printer 1 and parts and components in the laser printer 1 will be referred to based on a user's position to ordinarily use the laser printer 1 and in accordance with orientation indicated by arrows in each drawings. That is, for example, a viewer's right-hand side appearing in FIG. 1 is referred to as a front side of the laser printer 1. A left-hand side in FIG. 1 opposite from the front is referred to as a rear side. A side, which corresponds to the viewer's nearer side is referred to as a left-hand side, and an opposite side from the left, which corresponds to the viewer's farther side, is referred to as a right-hand side. A right-to-left or left-to-right direction of the laser printer 1 may also be referred to as a widthwise direction. A front-to-rear or rear-to-front direction may also be referred to as a front-rear direction. An up-to-down or down-to-up direction in FIG. 1 corresponds to a vertical direction of the laser printer 1. The widthwise direction, the front-rear direction, and the vertical direction are orthogonal to one another.

As shown in FIG. 1, the laser printer 1 includes a casing 2, a feeder unit 3, an exposure unit 4, a processing cartridge 5, and a fixing unit 8, which are accommodated in the casing 2.

The feeder unit 3 is disposed in a lower position in the casing 2 and includes a sheet storage device 100, a feeder roller 33, a separator roller 34, a conveyer roller 36, and registration rollers 37. The feeder unit 3 conveys sheets S stored in the sheet storage device 100 to the processing cartridge 5. More specifically, the sheets S stored in the sheet storage device 100 are lifted upward by a pressure board 120 to be urged against the feeder roller 33. The sheets S are forwarded by the feeder roller 33 and separated from one another by the separator roller 34 and a separator pad 35 to be conveyed one-by-one by the conveyer roller 36 and the registration rollers 37 to the processing cartridge 5.

The exposure unit 4 is disposed in an upper position in the casing 2 and includes a laser emitter (not shown), a polygon mirror, lenses, and reflective mirrors, which are shown but unsigned. A laser berm, which is indicated by a double-dotted line in FIG. 1, may be emitted from a laser source toward a photosensitive drum 51 to scan a circumferential surface of the photosensitive drum 51 so that the circumferential surface of the photosensitive drum 51 is selectively exposed to the laser beam.

The processing cartridge 5 is removably installed in the casing 2 through an opening (unsigned), which is formed on a front face of the casing 2 and exposed when a front cover (unsigned) is opened. The processing cartridge 5 includes the photosensitive drum 51, a charger 52, a transfer roller 53, a developer roller 54, a supplier roller 55, a toner-flattening blade 56, and a toner container 57 to contain toner.

In the processing cartridge 5, the circumferential surface of the photosensitive drum 51 is evenly charged electrically by the charger 52 and exposed selectively to the laser beam emitted from the exposure unit 4 as the photosensitive drum 51 rotates. Accordingly, electric potential in an area selectively exposed to the laser beam is lowered, and a latent image is formed in the lower potential area. Toner contained in the toner container 57 is supplied to the developer roller 54 through the supplier roller 55 and is flattened evenly by the toner-flattening blade 56 to form a predetermined thickness of a toner layer on the developer roller 54. The toner on the developer roller 54 is supplied to the latent image formed on the circumferential surface of the photosensitive drum 51 to be developed so that a toner image is formed on the circumferential surface of the photosensitive drum 51. Thereafter, the toner image on the circumferential surface of the photosensitive drum 51 is transferred by the developer roller 53 onto the sheet S, which is fed to the processing cartridge 5 by the feeder unit 3.

The fixing unit 8 is disposed in a rearward position with respect to the processing cartridge 5 and includes a heat roller 81 and a pressure roller 82. The pressure roller 82 is disposed to oppose the heat roller 81 and is arranged to press the heat roller 81. When the sheet S with the transferred toner image passes by an intermediate position between the heat roller 81 and the pressure roller 82, the toner transferred onto the surface of the sheet S is thermally fixed thereon. The sheet S with the thermally fixed image is carried by conveyer rollers 23, 24 and is released in a sheet outlet tray 22.

Figure 2:
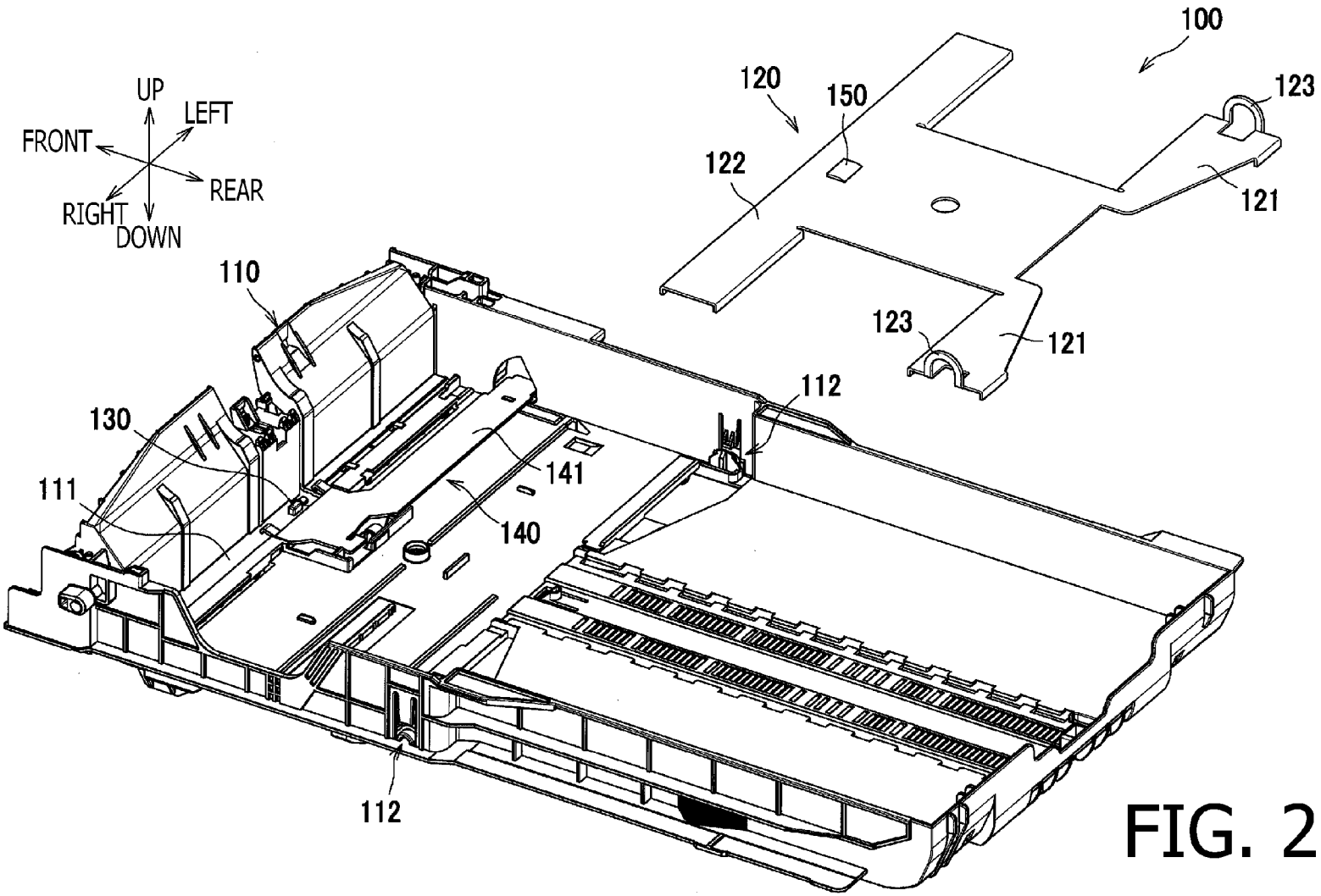
FIG. 2 is a perspective view of a sheet storage device according to the embodiment of the present disclosure.

As shown in FIG. 2, the sheet storage device 100 is detachably attached to a lower part of the casing 2. The sheet storage device 100 includes a storage tray 110, a pressure board 120, a projection 130 arranged in the storage tray 110, and a lifting plate 140. The pressure board 120 includes a rearward portion 121 and a frontward portion 122.

The storage tray 110 has a form of a top-open box, in which one or more sheets S may be stacked. A plurality of sheets S may be stored in a stack in the storage tray 110 (see also FIG. 1). In the following description, the sheet S may include a single sheet S and a stack of a plurality of sheets S. When the sheet S is to be stored in the storage tray 110, the sheet storage device 100 may be drawn out of the casing 2. The sheet S may be placed in the storage tray 110, and the sheet storage device 100 may be placed back in the casing 2.

The pressure board 120 is a piece of, for example, a metal, which may be press-formed. As shown in FIG. 1, the pressure board 120 is disposed in a frontward position in the storage tray 110. The sheet S stored in the storage tray 110 is placed on top of the pressure board 120.

Figure 3:
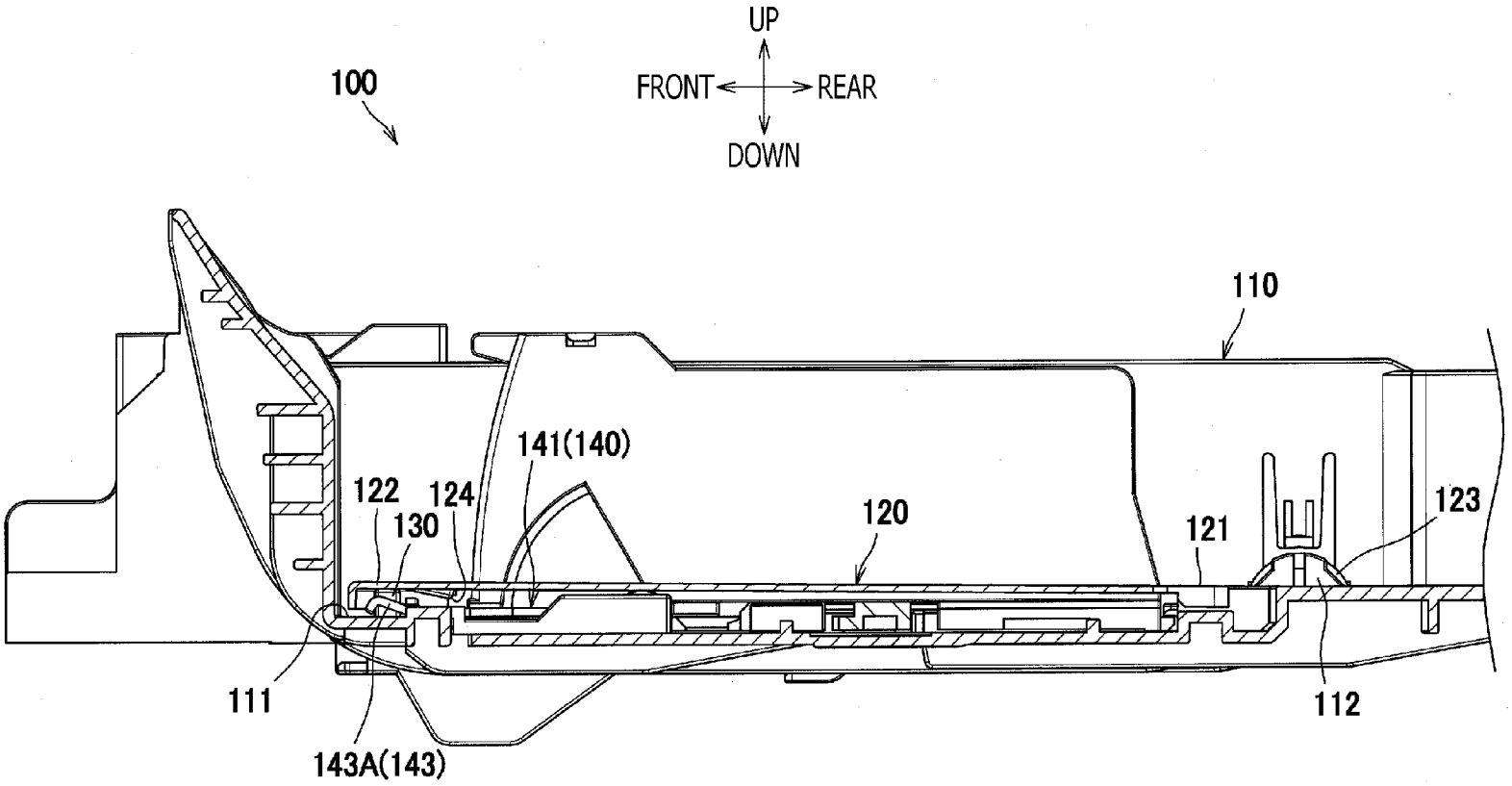
FIG. 3 is a cross-sectional side view of a front part of the sheet storage device according to the embodiment of the present disclosure.
Figure 4:
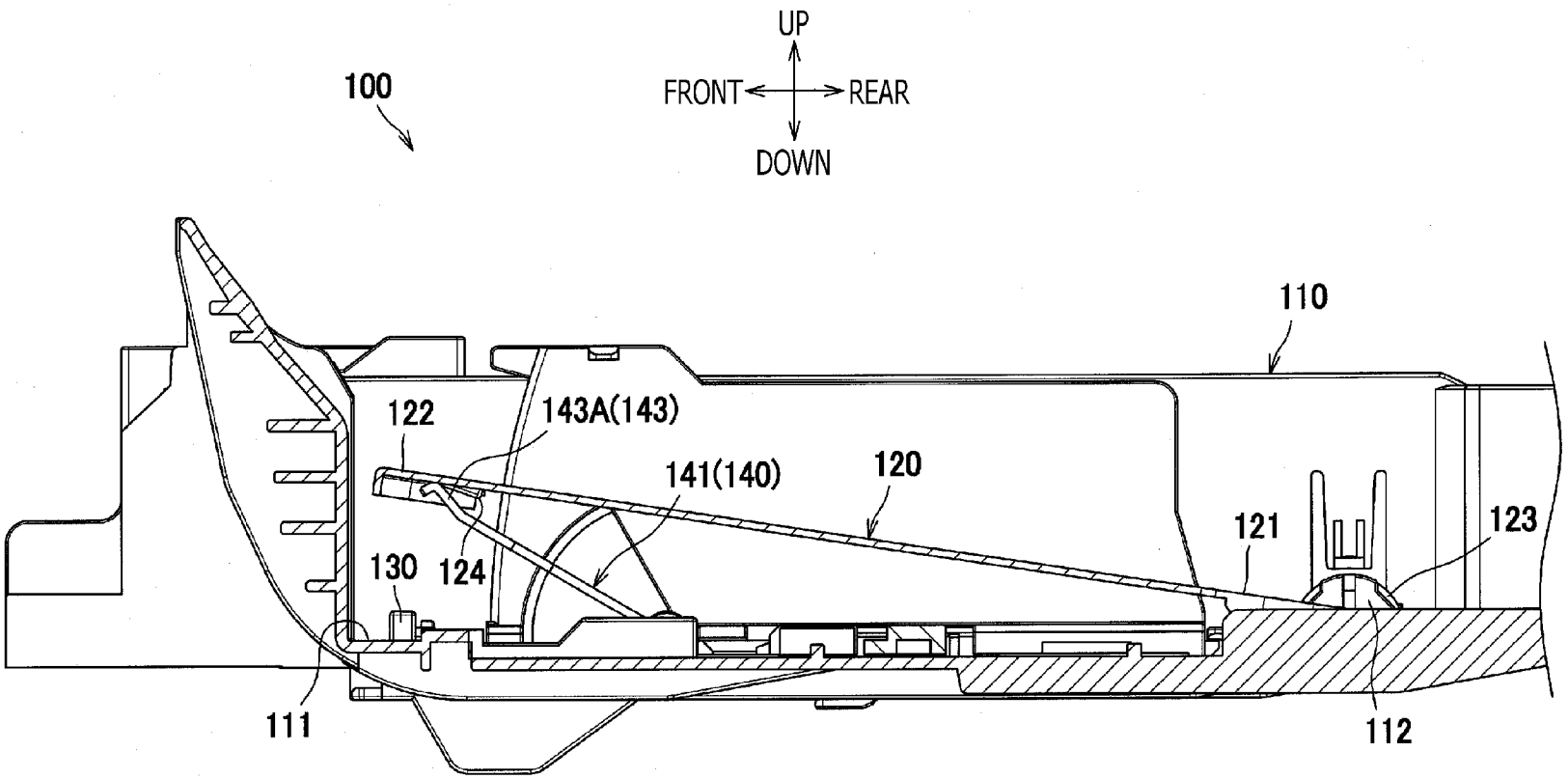
FIG. 4 is cross-sectional side view of the front part of the sheet storage device, in which a pressure board is moved upward, according to the embodiment of the present disclosure.

As shown in FIGS. 3 and 4, the pressure board 120 is swingably supported by the storage tray 110 at the rearward portion 121 thereof, which is at a position closer to the rear side than the front side, to be swingable about a swing axis 112, which is arranged in the storage tray 110. More specifically, the swing axis 112 includes two (2) pins, which are attached to lateral walls on the right and the left of the storage tray 110. Meanwhile, the pressure board 120 has a pair of bearings 123 at lateral ends of the rearward portion 121, and the pins of the swing axis 112 are arranged to engage with the bearings 123 so that the pressure board 120 is swingably supported by the storage tray 110 at the two (2) positions on the lateral ends of the rearward portion 121. Meanwhile, the frontward portion 122 of the pressure board 120 is freely movable up-and-down without being fixed or restricted.

Figure 5:
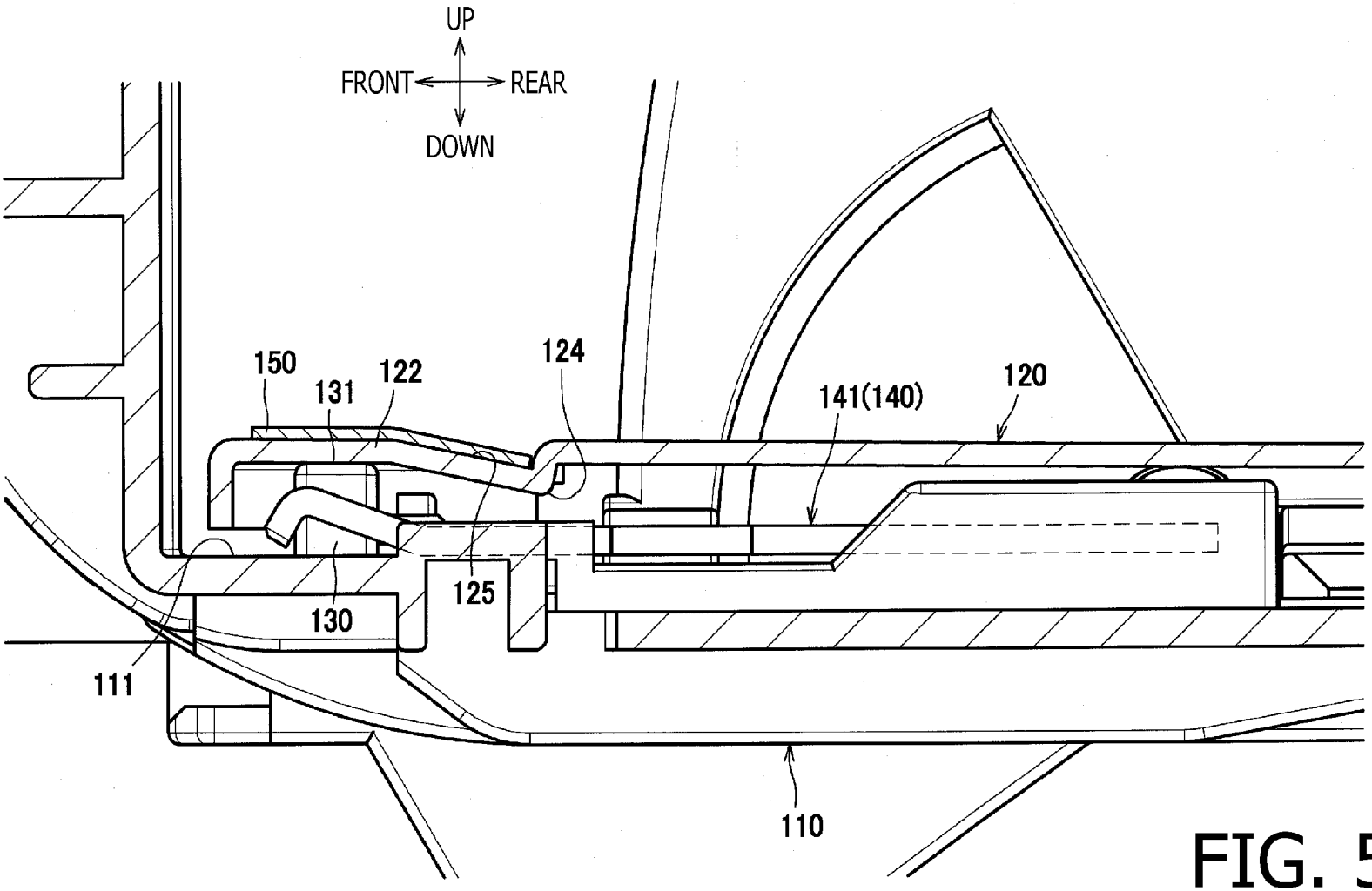
FIG. 5 is an enlarged cross-sectional side view of the front part of the sheet storage device according to the embodiment of the present disclosure.

As shown in FIG. 5, the pressure board 120 is formed to have a protrusive part 124, which may be press-formed and protrudes downward from a lower surface thereof at a widthwise center toward a bottom 111 of the storage tray 110. Meanwhile, the pressure board 120 is formed to have a recessed part 125, which dents downward from an upper surface thereof, on a reversed side of the protrusive part 124, at the widthwise center.

In the recessed part 125, placed is a friction member 150. The friction member 150 is a sheet made of a frictional material, which has a larger friction coefficient, such as cork and rubber. More specifically, the friction member 150 is in an arrangement such that a rear end thereof is placed in the recessed part 125 and a front end thereof is placed in a frontward position to protrude upward with respect to the upper surface of the pressure board 120. Thereby, the friction member 150 is enabled to contact a lower surface of the sheet S placed on the pressure board 120. Due to the frictional effect of the friction member 150, the sheet S in a lower position in the sheet stack may be restrained from moving along with other sheet S in an upper position in the sheet stack when the feeder roller 33 rotates to feed the upper sheets S.

The projection 130 is a formed to protrude from the bottom 111 of the storage tray 110 toward the pressure board 120 and has a contact part 131, which may contact a lower surface of the pressure board 120 at the frontward portion 122. More specifically, the projection 130 is formed to protrude upward from the bottom 111 of the storage tray 110 at a widthwise center of the frontward portion 122, and a top surface of the projection 130 includes the contact part 131. Therefore, the contact part 131 is at a position to be in contact with a widthwise central portion on the lower surface of the frontward portion 122 in the pressure board 120 (see FIG. 6). In particular, the contact part 131 is at a position to contact a frontward area with respect to the protrusive part 124, within the widthwise central portion on the lower surface of the frontward portion 122 in the pressure board 120. The projection 130 may be formed to have a shape of, for example, but not limited to, a quadratic block.

The pressure board 120 is, when the frontward portion 122 thereof is not lifted by the lifting plate 140, supported by the projection 130 with the lower surface of the frontward portion 122 being in contact with the contact part 131 of the projection 130. In this regard, the pressure board 120 is supported by the projection 130 at the widthwise center in the frontward portion 122, and by the swing axis 112 attached to the storage tray 110 at the widthwise ends in the rearward portion 121 (see FIG. 6). In other words, the pressure board 120 is, when not uplifted, supported at three (3) positions: by the projection 130 at the widthwise center on the front, and by the swing axis 112 at the widthwise ends on the rear.

A length L1 of the contact part 131 along the widthwise direction is smaller than a length L2 of the pressure board 120 at the frontward portion 122 along the widthwise direction. Further, the widthwise length L1 of the contact part 131 is smaller than a length L3 of the friction member 150 along the widthwise direction. The widthwise length L1 of the contact part 131 may be, for example, as small as 1/20 of the widthwise length L2 of the pressure board 120 at the frontward portion 122.

Figure 7:
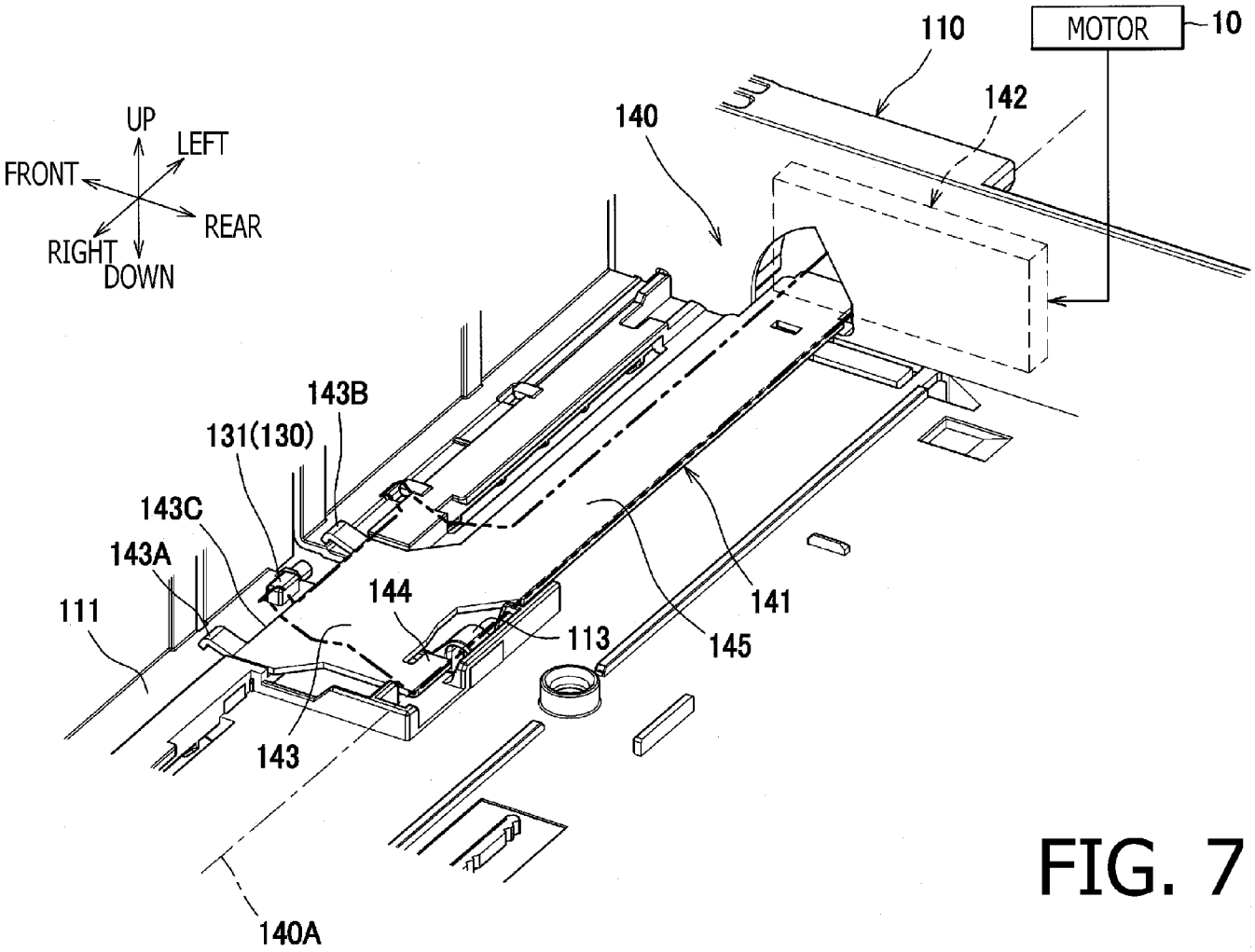
FIG. 7 is a perspective view of a protrusive part and a lifting plate in the sheet storage device according to the embodiment of the present disclosure.

As shown in FIG. 4, the lifting plate 140 is configured to be driven by input of a driving force from a motor 10 (see FIG. 7), transmitted within the casing 2, to uplift the pressure board 120 at the frontward portion 122 when the sheet S stored in the storage tray 110 is picked up by the feeder roller 33. As the frontward portion 122 of the pressure board 120 is uplifted by the lifting plate 140, as shown in FIG. 1, the sheet S is shifted be closer to the feeder roller 33 at frontward end thereof and is enabled to be fed by the feeder roller 33. As shown in FIG. 7, the lifting plate 140 includes a lifting body 141 and a driving unit 142.

The lifting body 141 is arranged underneath the pressure plate 120 in the storage tray 110 and is configured to be moved by input of the driving force to swing upward and uplift the frontward portion 122 of the pressure board 120. The lifting body 141 includes a lifting protrusion 143, a shaft part 144, and a coupler part 145.

Figure 6:
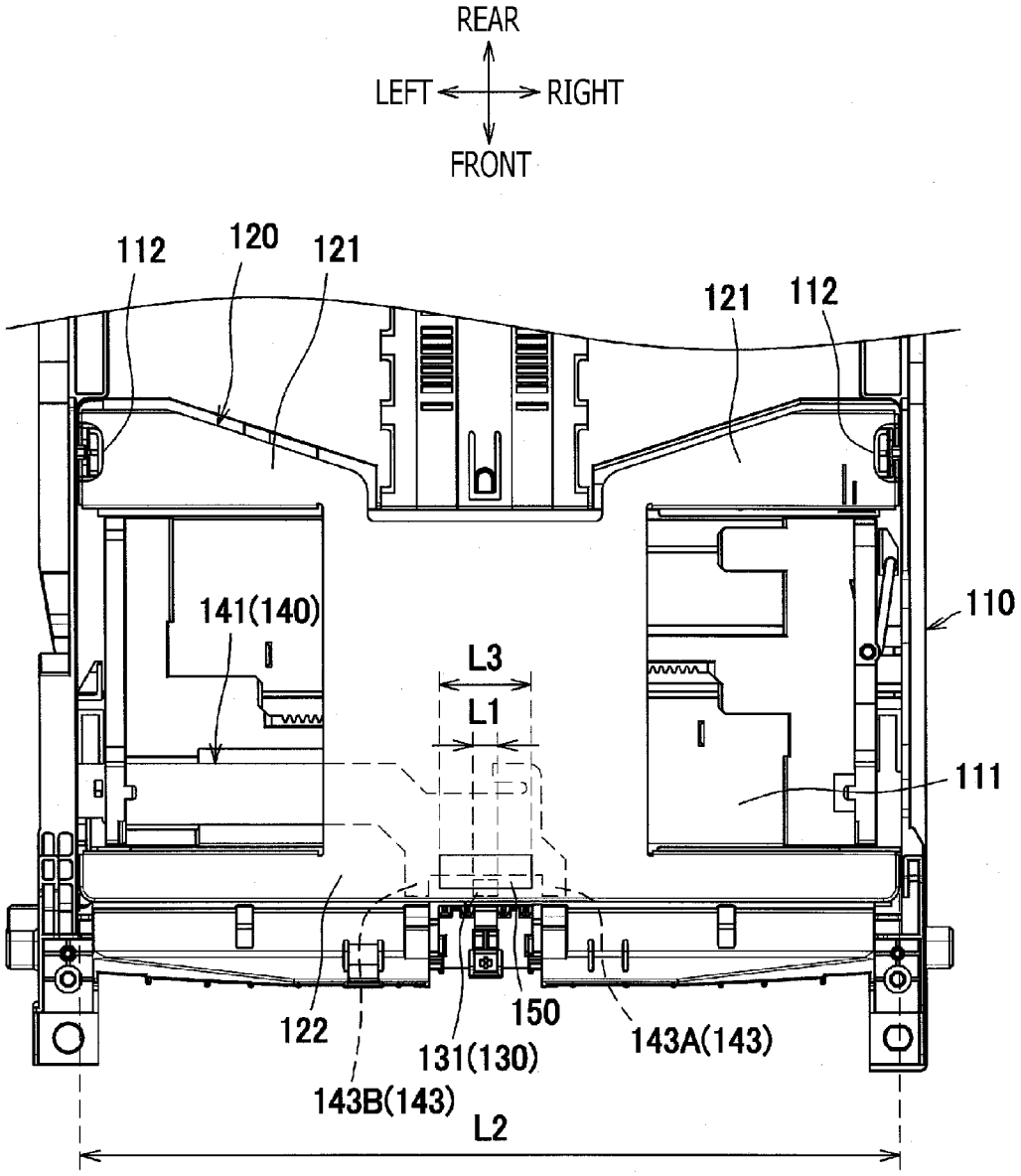
FIG. 6 is a plan view of the front part of the sheet storage device according to the embodiment of the present disclosure.

The lifting protrusion 143 is arranged underneath the frontward portion 122 at a widthwise center of the pressure board 120 and includes a first lifting protrusion 143A and a second lifting protrusion 143B, which may contact the pressure board 120 when the lifting plate 140 uplifts the pressure board 120 (see FIG. 6). The first lifting protrusion 143A and the second lifting protrusion 143B are each arranged laterally on a rightward side and a leftward side of the projection 130 including the contact part 131, respectively. In other words, the lifting protrusion 143 has the first lifting protrusion 143A and the second lifting protrusion 143B that protrude frontward at front and widthwise ends thereof so that a recess 143C is formed between the first lifting protrusion 143A and the second lifting protrusion 143B. Meanwhile, the projection 130 is, when the lifting body 141 is not moved to swing, as indicated by solid lines in FIG. 7, placed inside the recess 143C to be bracketed by the first lifting protrusion 143A and the second lifting protrusion 143B.

The shaft part 144 is arranged in a rearward position with respect to the contact part 131 and is formed to stretch rearward from a rear end of the lifting protrusion 143 and to extend leftward. As the shaft part 144 is rotatably supported by a bearing 113 arranged on the bottom 111 of the storage tray 110, the lifting body 141 is swingably supported by the storage tray 110 to swing about an axis 140A, which extends along the widthwise direction in a rearward position closer to the rearward portion 121 of the pressure board 120 with respect to the contact part 131.

The coupler part 145 is formed to stretch leftward from the lifting protrusion 143, and a leftward end thereof is coupled to a driving unit 142, which is driven by the motor 10. Thus, the driving force transmitted to the driving unit 142 is further transmitted to the lifting body 141 through the coupler part 145.

The driving unit 142 is arranged on an outer surface of a leftward wall of the storage tray 110 and is configured to drive the lifting body 141. The laser printer 1 is equipped with the motor 10 that supplies the driving force to the lifting plate 140 in the casing 2, and when the sheet S is conveyed from the storage tray 110, the driving force is generated in the motor 10 and transmitted to the driving unit 142 so that the driving unit 142 is driven to move the lifting body 141 to swing, as shown in double-dotted lines in FIG. 7. Accordingly, the first lifting protrusion 143A and the second lifting protrusion 143B shift upward to contact and uplift the frontend area 112 of the pressure board 120 (see FIG. 4). The configuration of the driving unit 142 may be a known driving mechanism, and detailed description of that will be herein omitted.

According to the laser printer 1 described above, with the contact between the frontward portion 122 of the pressure board 120 and the contact part 131 of the projection 130 arranged on the bottom 111 of the storage tray 110, the pressure board 120 may be retrained from rattling in a way such that each lateral edge at the frontward portion 122 of the pressure board 120 conflicts with the bottom 111 of the storage tray 110 alternately even when vibration is caused in the sheet storage device 100 as the sheet storage device 100 is moved with respect to the casing 2 to be, for example, drawn out of or installed into the casing 2. Therefore, rattling noise which may be produced when the sheet storage device 100 is handled may be reduced.

In particular, according to the embodiment described above, the contact part 131 is at the position to contact the widthwise central portion of the frontward portion 122 of the pressure board 120. Therefore, compared to a configuration, in which a contact part is in a widthwise lopsided position, the rattling noise that may be produced when each lateral edge at the frontward area 122 of the pressure board 120 conflicts with the bottom 111 of the storage tray 110 alternately due to the vibration, which may be caused when the sheet storage device 100 is handled, may be reduced.

Further according to the embodiment described above, the lifting body 141 is in the arrangement such that the axis 140A is in the rearward position with respect to the contact part 131, and the first lifting protrusion 143A and the second lifting protrusion 143B in the frontward area 122 are arranged to sandwich the contact part 131 in there-between. In this regard, the lifting protrusion 143, including the first lifting protrusion 143A and the second lifting protrusion 143B, may contact the pressure board 120 at the frontward portion 122 to uplift the pressure board 120. Therefore, a swingable angle, or a driven amount, of the lifting body 141 may be restrained to be smaller, while a movable amount of the pressure board 120 at the frontward portion 122 may be maintained.

Further, according to the embodiment described above, while the friction member 150 is disposed in the recessed part 125, which is the reversed structure of the protrusive part 124, the recessed portion 125 may be effectively used as a mount for the friction member 150. Therefore, compared to a configuration, in which the mount for the friction member is formed separately from the recessed part 125 being a reversed form of the protrusive part 124, the structure of the pressure board 120 may be more effectively simplified.

Although an example of carrying out the invention has been described, those skilled in the art will appreciate that there are numerous variations and permutations of the sheet storage device and the image forming apparatus that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

Figure 8:
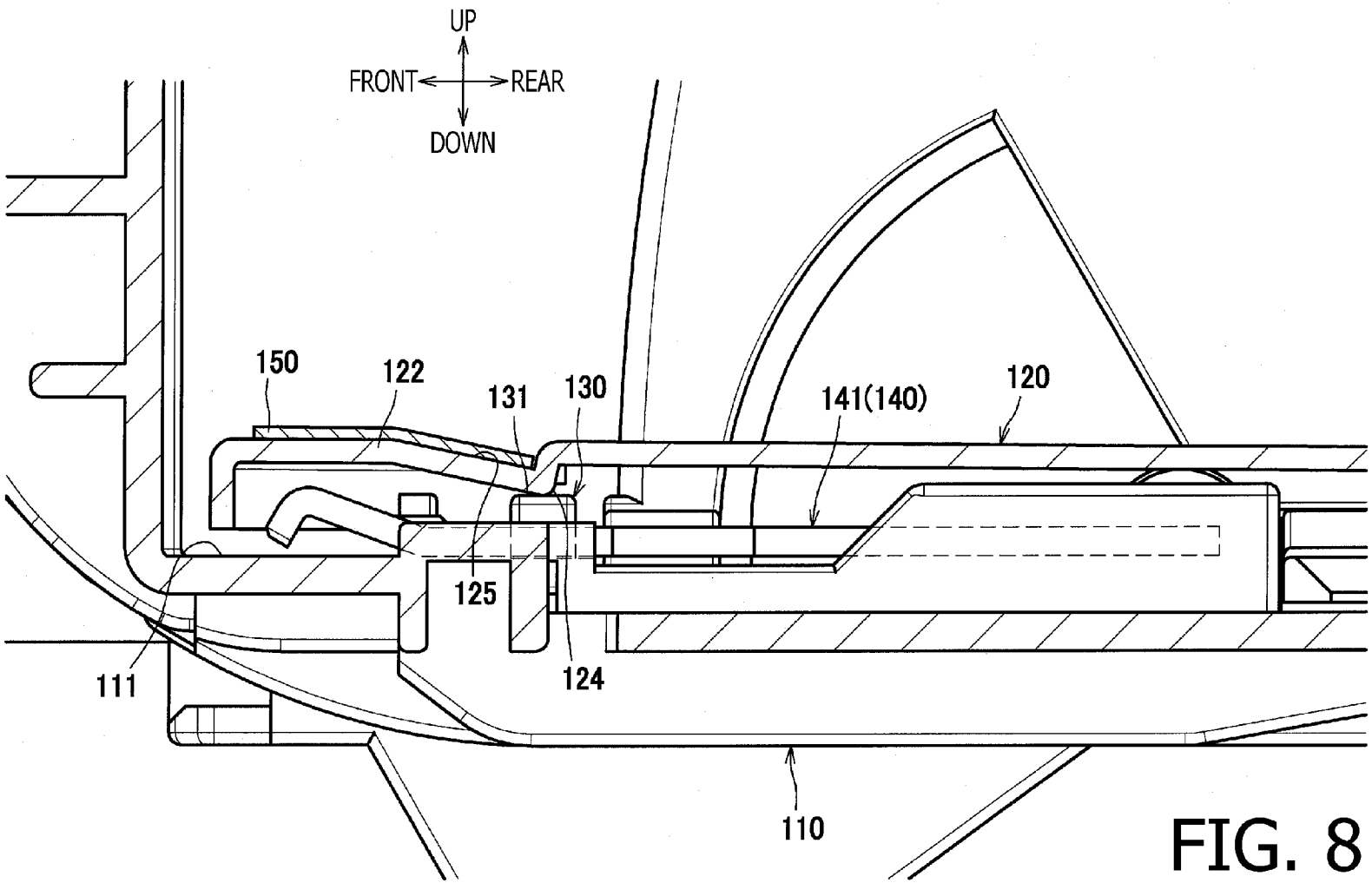
FIG. 8 is a cross-sectional side view of a front part of a sheet storage device in a modified example according to the embodiment of the present disclosure.

For example, the contact part 131 may not necessarily be disposed in the position to contact the frontward area with respect to the protrusive part 124 to contact the frontward portion 122 of the pressure board 122, as shown in FIG. 5. For example, the contact part 131 may be disposed in a position to contact the protrusive part 124 on the lower face of the pressure board 120, as shown in FIG. 8. According to this arrangement, a protrusive amount (height) for the projection 130 to protrude from the bottom 111 of the storage tray 110 may be reduced.

For another example, the shape of the protrusion 130 may not necessarily be limited to the quadratic block but may be, for example, a round columnar shape or a block more widely elongated along the widthwise direction. For another example, the projection 130 may not necessarily provide the contact part 131 at the top face thereof but may have a protrusive portion farther protruded toward the pressure board 120 so that the farther protrusive portion may serve as the contact part 131.

For another example, the lifting protrusion 143 may not necessarily contact the pressure board 120 at the two (2) positions, i.e., by the first lifting protrusion 143A and the second lifting protrusion 143B, but may contact the pressure board 120 at one (1) position, or three (3) or more positions.

For another example, the swing axis 112 may not necessarily be disposed in the storage tray 110 but may be included in, for example, the pressure board 120.

For another example, the embodiment described above may not necessarily be applied to the laser printer 1, which is configured to print monochrome images, but may be applied to a multicolor laser printer. For another example, the embodiment may not necessarily be applied to an electro-photographically printable laser printer but may be applied to, for example, an inkjet printer or a thermal printer. Further, the embodiment described above may not necessarily be applied to a printer but may be applied to, for example, a copier or a multifunction peripheral device, which is equipped with an image reading device such as a flatbed scanner.

For another example, the sheet storage device 100 may not necessarily be included in the laser printer 1 but may be configured as an optional tray, which may be additionally attached to the laser printer 1. For another example, the sheet storage device 100 may not necessarily be applied to an image forming apparatus but may be applied to a sheet-conveying device and to an apparatus that may supply the sheet to the sheet-conveying device.

What is claimed is:

1. A sheet storage device, comprising:

a storage tray configured to store a sheet therein;

a board, on which the sheet to be stored in the storage tray is placed, the board being configured to be swingably supported by the storage tray at a first position closer to a first end thereof than a second end being opposite from the first end to swing about a swing axis; and a projection configured to protrude from a bottom of the storage tray toward the board, the projection comprising a contact part configured to contact the board at a second position closer to the second end than to the first end of the board, a lifting plate configured to be driven by input of a driving force and configured to uplift the board at the second position closer to the second end;

wherein a length of the contact part along an axial direction being a direction of the swing axis is smaller than a length of the board at the second position closer to the second end along the axial direction;

wherein the lifting plate comprises a lifting body configured to be swingably supported by the storage tray to swing about an axis extending along the axial direction, the lifting body being configured to swing by the input of the driving force to uplift the board at the second position closer to the second end, wherein the lifting body comprises a lifting protrusion protruding toward the second end of the board, the lifting protrusion being configured to con tact the board, wherein the lifting protrusion comprises a first lifting protrusion and a second lifting protrusion arranged to sandwich the contact part in there-between along the axial direction, and wherein when the lifting body is in a position to lower the board, the lifting protrusion is at a height lower than a height of the projection.

2. The sheet storage device according to claim 1, wherein the contact part is arranged in a position to contact a central position along the axial direction of the board at the second position closer to the second end.

3. The sheet storage device according to claim 2, wherein the board comprises a protrusive part formed to protrude at a third position closer to the second end than to the first end toward the bottom of the storage tray, and wherein the contact part is in a position to contact the protrusive part.

4. The sheet storage device according to claim 3, wherein the second position and the third position are at a same position on the board.

5. The sheet storage device according to claim 3, wherein the board comprises a recessed part formed at a reversed surface from the protrusive part, and wherein a frictional member configured to contact the sheet placed on the board is disposed in the recessed part.

6. The sheet storage device according to claim 5, wherein the length of the contact part along the axial direction is smaller than a length of the friction member along the axial direction.

7. An image forming apparatus, comprising:

a casing comprising a drive source configured to generate a driving force; and a sheet storage device configured to be movable with respect to the casing, the sheet storage device comprising:

a storage tray configured to store a sheet therein;

a board, on which the sheet to be stored in the storage tray is placed, the board being configured to be swingably supported by the storage tray at a first position closer to a first end thereof than a second end being opposite from the first end to swing about a swing axis;

a projection configured to protrude from a bottom of the storage tray toward the board, the projection comprising a contact part configured to contact the board at a second position closer to the second end than to the first end of the board; and a lifting plate configured to be driven by input of the driving force, the lifting plate being configured to uplift the board at the second position closer to the second end, wherein the first position closer to the first end of the board is supported at lateral ends thereof along an axial direction being a direction of the swing axis, wherein a length of the contact part along the axial direction is smaller than a length of the board at the second position closer to the second end along the axial direction, wherein the lifting plate comprises a lifting body configured to be swingably supported by the storage tray to swing about an axis extending along the axial direction, the lifting body being configured to swing by the input of the driving force to uplift the board at the second position closer to the second end, wherein the lifting body comprises a lifting protrusion protruding toward the second end of the board, the lifting protrusion being configured to contact the board, wherein the lifting protrusion comprises a first lifting protrusion and a second lifting protrusion arranged to sandwich the contact part in there-between along the axial direction, and wherein when the lifting body is in a position to lower the board, the lifting protrusion is at a height lower than a height of the projection.

* * * * *